United States Patent [19]

Blevins et al.

[11] Patent Number: 4,512,178

[45] Date of Patent: Apr. 23, 1985

[54] TUBE END DEFORMING TOOL

[75] Inventors: Milton L. Blevins, Chattanooga; Charles R. Seiter, Hixson, both of Tenn.

[73] Assignee: Combustion Engineering, Inc., Windsor, Conn.

[21] Appl. No.: 479,762

[22] Filed: Mar. 28, 1983

[51] Int. Cl.[3] ..... B21D 41/02; B21D 53/02

[52] U.S. Cl. ..... 72/393; 29/157.3 C; 72/75

[58] Field of Search ..... 72/75, 120, 123, 125, 72/393; 29/157.3 C, 727

[56] References Cited

U.S. PATENT DOCUMENTS

| | | | |
|---|---|---|---|
| 465,957 | 12/1891 | Willmott | 72/393 |
| 1,279,130 | 9/1918 | Leonard | 72/75 |
| 2,190,386 | 2/1940 | Scholtes | 72/75 |
| 2,393,283 | 1/1946 | Boyles et al. | 72/370 |
| 2,657,733 | 11/1953 | Champion | 72/75 |
| 3,176,492 | 4/1965 | Francus | 72/75 |
| 3,339,388 | 9/1967 | Cann | 72/75 |
| 3,640,115 | 2/1972 | Duncan et al. | 72/75 |

FOREIGN PATENT DOCUMENTS

| | | | |
|---|---|---|---|
| 926748 | 5/1973 | Canada | 72/75 |
| 1031257 | 6/1958 | Fed. Rep. of Germany | 72/123 |
| 603885 | 6/1948 | United Kingdom | 72/123 |

*Primary Examiner*—Lowell A. Larson
*Attorney, Agent, or Firm*—Robert L. Olson

[57] ABSTRACT

A tube deforming tool (10) for forming a plurality of dimples (32) in the end of a tube (34) of a predetermined size. The tool has a tapered mandrel (12) extending through a housing (14) containing a plurality of radially movable balls (16). A plurality of longitudinal grooves (20) in the mandrel is the surface that the balls coact with. At the end of each groove is an enlarged recess (40) into which the balls are released at the end of the dimpling or deforming procedure, to permit easy removal of the tool from the deformed tube.

4 Claims, 3 Drawing Figures

TUBE END DEFORMING TOOL

BACKGROUND OF THE INVENTION

This invention is directed to a tool for "dimpling" the end of a tube in a controlled manner, without deforming the tube end in such a manner that it is completely out of round. In the past, boiler tubes have been connected to drums by first inserting a tube end into a hole in the lower portion of the drum. A worker located in the drum interior then would manually strike the end of the tube a number of times until the tube end becomes so deformed that the tube would hang by itself from the drum. The lower tube end would then be inserted into a hole in the upper portion of a lower drum. At this point the tube would be hanging from the top drum supported by the deformed end, along with innumerable similar such tubes. The next step generally involved expanding the tube end by a rolling operation, in which the end of the tube is flared, or expanded into tight engagement with the walls of the opening in the drum.

Certain boiler constructions today make it a requirement to weld the tube ends into the drum. In order to maintain high quality welds, it is necessary that the tube ends be round, within limits. Under the old method of deforming the tube ends, this required an additional step of rerounding the deformed tube end prior to welding.

SUMMARY OF THE INVENTION

The tool of the invention can be used to controllably deform the end of a tube by placing a plurality of dimples therein without causing the tube end to be so disfigured that it requires rerounding before welding. The tool includes a cage or housing containing a plurality of balls therein. A tapered mandrel extends up through the cage, which is positioned in the tube end. The mandrel is forced by an impact means, such as an air hammer, a given longitudinal distance through the cage, causing the balls to move radially a given distance, thus forming dimples of a given magnitude in the tube end. the mandrel has longitudinal grooves therein of partial circular cross-section which contact each of the balls. This prevents the mandrel from becoming deformed too quickly during usage. Enlarged indentations or recesses at the end of each groove act as a ball release to enable the tool to be easily removed from the tube end after the dimpling operation. A removable stop on the mandrel prevents the mandrel from becoming disassembled from the cage or ball housing, so an operator can quickly move from one tube to another.

DESCRIPTION OF THE PREFERRED EMBODIMENT

Figure 1:
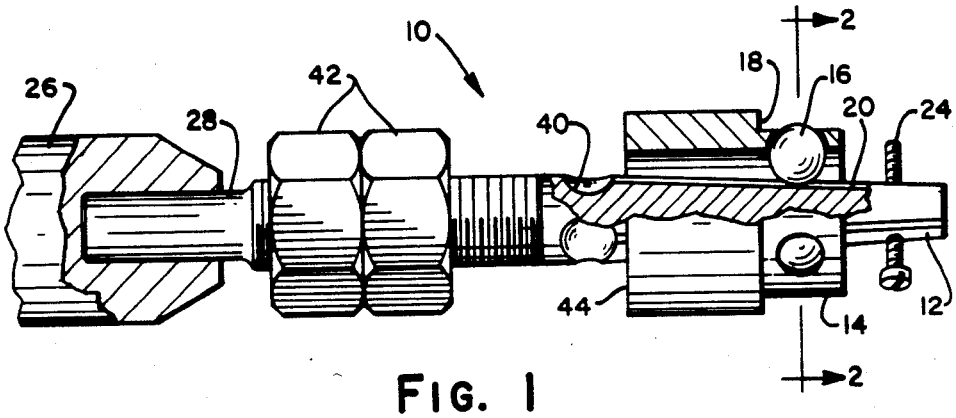
FIG. 1 is a side view shown partially in section of the deforming tool of the invention.
Figure 2:
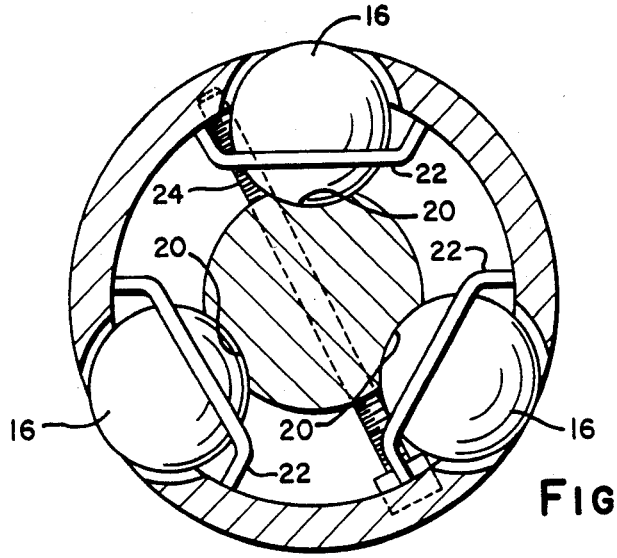
FIG. 2 is an enlarged view taken on line 2—2 of FIG. 1.

Looking now to FIG. 1, numeral 10 designates the deforming tool in its entirety. A tapered mandrel 12 extends through a ball housing 14, which houses three equally spaced balls 16. A collar 18 is for the purpose of abutting up against the end of a tube which is to be dimpled or deformed. A plurality of grooves or channel 20 are provided in the tapered mandrel 12 in which each of the balls 16 is in contact. The grooves are for the purpose of preventing the mandrel itself, or the balls, from becoming deformed or damaged. Without the grooves, the point contact between each of the balls 16 and the mandrel 12 could result in the formation of flat spots on either or both of the mandrel and the balls. As seen in FIG. 2, there is contact between each groove and ball throughout an arc of approximately 60° or more.

Also as seen in FIG. 2, each ball 16 is retained within a separate grid or cage 22, which prevents the ball from falling out of housing 14 if the mandrel 12 were completely removed. The openings in housing 14 in which the balls 16 reside are restricted toward the outer surface such that they permit the balls to extend partially outward therefrom, for example, when forced outwardly by the tapered mandrel 12, but they do not permit the balls from escaping therefrom. The openings are of slightly less diameter than the balls 16.

During normal usage of the deforming tool, an operator will be deforming or dimpling the ends of a great many tubes at one time. Thus, it is desirable to keep the mandrel 12 from being completely removed from the housing 14, which would require repetitive reassembling of the tool. As shown in FIGS. 1 and 2, a bolt 24 is threaded through a threaded opening in the end of the mandrel. The two ends of the bolt 24 extend outwardly a sufficient distance to contact the end of housing 14 when the mandrel is withdrawn outwardly, or to the left as seen in FIG. 1. Obviously, the bolt 24 must not be of such length that it will not be capable of being inserted inside of the tube that is being dimpled. Thus it must be smaller than, or no larger than the outer diameter of housing 14 (see FIG. 2).

Figure 3:
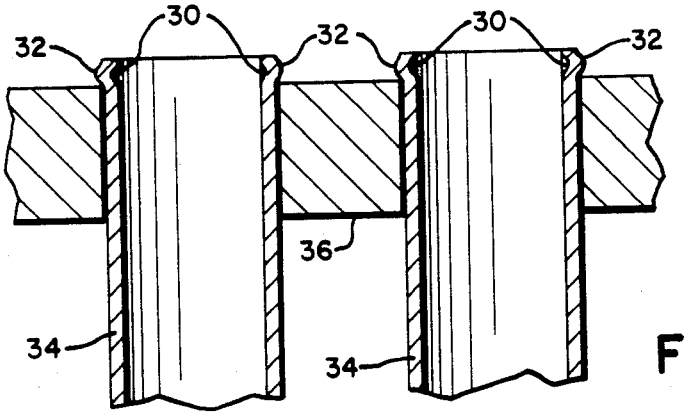
FIG. 3 shows tubes which have been deformed with the tool.

The force for moving the mandrel 12 longitudinally through the ball housing 14 is supplied by an impact hammer, the chuck 26 of which is shown in engagement with the shaft 28 of the tool. Repeated blows to the end of the tool will force the mandrel 12 to the right, as seen in FIG. 1. With the ball housing stationary, such as when the collar 18 is in contact with the end of a tube, longitudinal movement of the tapered mandrel will force the balls 16 radially outward, forming three equally spaced indentations on the inner surface of a tube. These indentations 30 cause dimples 32 on the outer surface of the tube 34, as seen in FIG. 3. FIG. 3 shows a pair of tubes 34 having ends extending through a drum wall 36, which tube ends have been deformed or dimpled. The dimples 32 will hold the tubes in place within the drum wall while the next operation is performed, for example welding the tubes in place to the drum wall.

As mentioned earlier, it is desirable to deform or dimple the tubes in a predictable, repeatable manner. This is possible with the present tool. As shown in FIG. 3, the end of each groove 20 opens into a recess 40. After the mandrel 12 has moved a given longitudinal distance through the ball housing 14, causing radial movement of balls 16 a given distance, the balls 16 fall into the recesses 40, and no further enlargement of the tube dimples occur. A pair of lock nuts 42 can be adjustably positioned on the threaded portion of shaft 28, such that they encounter surface 44 at the rear end of the ball housing, preventing further movement of the mandrel 12 to the right. Thus if an operator fails to feel the balls 16 drop into the recesses 40, the lock nuts 42 will shortly thereafter stop further movement of the mandrel. The tool can thereafter be pulled from the tube. During this action, bolt 24 will prevent the mandrel from being removed from the ball housing 14. To aid in the removal, an operator can grasp the enlarged portion 44 of the ball housing with his free hand, if he so desires.

As mentioned earlier, the recesses 40 serve two purposes. First, they stop further enlargement of the dimples on the tubes. And secondly, they release the balls from their tight engagement with the inner surface of the tube, thus permitting easy removal of the tool from the tube without the use of excessive force.

We claim:

1. A tube deforming tool including a tapered mandrel, the mandrel having a small diameter at its forward end and a larger diameter at its rearward end, a housing with a plurality of radially movable balls mounted therein surrounding the mandrel, the housing having a forward end closest to the forward end of the mandrel, and a rearward end closest to the rearward end of the mandrel, the housing having openings therein adjacent the location of each ball, collar means surrounding the mandrel at the rearward end of the housing and adapted to abut against the end of the tube to be deformed, means for moving the mandrel without rotation thereof, but longitudinally of the ball housing, a plurality of longitudinal grooves in the mandrel, therebeing one for each ball, the grooves being such that as the mandrel is moved longitudinally through the ball housing into the tube interior, the balls are moved radially outwardly by the increasing diameter of the tapered mandrel, until the balls contact and eventually deform the tube wall, an enlarged recess at the end of each of the grooves near the rearward end of mandrel, such that when the balls drop into the recesses, they are removed from contact with the tube wall, thereby forming dimples of a given size in the outer tube wall and permitting easy withdrawal of the tool from the tube.

2. The tube deforming tool set forth in claim 1, including means near the forward end of the mandrel which prevents the mandrel from being completely removed from the ball housing.

3. The tube deforming tool set forth in claim 2, including means on the mandrel which contacts the collar means, limiting the longitudinal movement of the mandrel in a direction into the tube.

4. The tube deforming tool of claim 3, wherein each of the balls is in contact with its respective groove through approximately a 60° arc.

* * * * *